US009821596B2

(12) United States Patent
Wurtzel

(10) Patent No.: US 9,821,596 B2
(45) Date of Patent: Nov. 21, 2017

(54) VORTEX GENERATOR

(71) Applicant: Daniel Wurtzel, Brooklyn, NY (US)

(72) Inventor: Daniel Wurtzel, Brooklyn, NY (US)

( * ) Notice: Subject to any disclaimer, the term of this patent is extended or adjusted under 35 U.S.C. 154(b) by 0 days.

(21) Appl. No.: 15/242,857

(22) Filed: Aug. 22, 2016

(65) Prior Publication Data

US 2017/0089347 A1 Mar. 30, 2017

Related U.S. Application Data

(60) Provisional application No. 62/235,014, filed on Sep. 30, 2015.

(51) Int. Cl.

| | |
|---|---|
| ***B44C 3/00*** | (2006.01) |
| ***G09F 19/00*** | (2006.01) |
| ***F04D 17/16*** | (2006.01) |
| ***F04D 25/16*** | (2006.01) |
| ***F04D 29/44*** | (2006.01) |

(52) U.S. Cl.

CPC ..... *B44C 3/00* (2013.01); *F04D 17/16* (2013.01); *F04D 25/166* (2013.01); *F04D 29/441* (2013.01); *G09F 19/00* (2013.01)

(58) Field of Classification Search

CPC ..... G09F 13/24; G09F 19/02; G09F 19/08; G09F 19/00; G09F 19/10; G09F 2019/086; F21S 10/002; B44C 3/00; F04D 29/4206; F04D 29/281; F04D 25/16

USPC ..... 472/65, 68, 137; 40/406, 407; 244/173, 244/172.6

See application file for complete search history.

(56) References Cited

U.S. PATENT DOCUMENTS 3,372,873 A * 3/1968 Weiss ..... A62C 5/002 239/99
3,589,044 A * 6/1971 Morrison ..... G09F 19/10 40/407
4,258,912 A * 3/1981 Reighart, II ..... A63F 9/00 40/408
4,452,562 A * 6/1984 Hsu ..... F03D 1/04 415/208.1
4,716,022 A * 12/1987 Priestley, Jr. ..... B01D 46/00 156/345.21
4,817,311 A * 4/1989 Ong S. T. ..... G09F 19/00 40/406
5,055,031 A * 10/1991 Werner ..... F21S 10/04 431/126
5,096,467 A * 3/1992 Matsui ..... B65G 53/24 454/189
5,322,646 A * 6/1994 Wright ..... F24F 6/12 261/79.2
5,502,908 A * 4/1996 Powell ..... G09F 19/02 40/409
5,971,765 A * 10/1999 Gill ..... G09B 23/12 434/217

(Continued)

FOREIGN PATENT DOCUMENTS

JP 2007209602 A * 8/2007

*Primary Examiner* — Cassandra H Davis
(74) *Attorney, Agent, or Firm* — Ladas+Parry LLP

(57) ABSTRACT

A vortex generator for use in establishing air fountains, kinetic sculptures, or unique stage effects comprised of a circular planar stage upon the surface of which a central vertical updraft is created by forced swirling air emanating from a cylindrical plenum beneath the stage, the air exiting through a circular orifice and lip forming a circumferential flow restrictor encircling the stage.

14 Claims, 11 Drawing Sheets

(56) References Cited

U.S. PATENT DOCUMENTS 6,254,489 B1 * 7/2001 Drobnis ..... A63J 5/021
472/59

* cited by examiner

VORTEX GENERATOR

The present application claims the benefit of U.S. Provisional Patent Application Ser. No. 62/235,014 filed Sep. 30, 2015.

BACKGROUND OF THE INVENTION

Over the years, artists have utilized common materials and objects as elements in dramatic sculptures and installations. Kinetic sculptural works have evolved in which circular focused arrays of fans have been assembled to generate invisible vortices of air, or "air fountains," which in combination with lightweight, aerodynamic materials create startling dramatic, kinetic visages. Such kinetic sculptures, in addition to being aesthetic works of art, have been utilized in theatrical, dramatic, and/or musical performances to enhance the sensory experiences of viewers.

Various systems and methods for generating artificial tornados and other vortex phenomena have been disclosed in prior art patents including U.S. Pat. No. 5,591,765 to Gill et al., U.S. Pat. No. 3,589,044 to Morrison et al., and U.S. Pat. No. 5,096,467 to Matsui. None have involved kinetic sculptures and/or generators of special aesthetic effects.

The present invention is directed to new and improved vortex generators for kinetic artwork and special visual effects generators.

BRIEF SUMMARY OF THE PRESENT INVENTION

The present invention is a vortex generator that produces a vortical updraft above the center of the circular flat top surface of the base of a kinetic sculpture or stage, in which deployed lightweight materials ascend from the base or stage and fly freely in the generated vortex. The flying materials ascend and descend endlessly above the flat base of the new vortex generator. The new invention comprises a disc-shaped, drum-like enclosure, with a series of internal fans or blowers generating a laminar airflow that emanates from a circular peripheral orifice established around the perimeter of the top, flat circular surface of the generator. Airflow from the circular perimeter orifice is directed horizontally across the flat top surface of the base toward the center or slightly off center of the circular base. The generated airflow, upon reaching the center of the circular base, forces those deployed lightweight materials within the system to ascend either directly straight up or upwardly in a vertical, spiral pattern in the generated vortex. The upward moving vortex has a predetermined degree of rotational spin around a vertical axis located at the center of the circle, the precise rotation depending on the fan arrangement and power. The new vortex generator may be made at virtually any scale for use as base for a kinetic sculpture or special effect generator; part of an architectural installation; built into a larger flat surface; or as a round, movable stage unto itself.

In a preferred iteration, the disc shaped, drum-like enclosure has a lower circular opening into which a number of centrifugal fans are mounted, blowing air into the enclosed plenum and pressurizing it. These fans are focused outwardly towards the perimeter wall of the enclosure at predetermined angles which generate rotational spin in the upward rising vortex generated above the top surface. Air that emanates from the fans passes around interior baffles that function to control air pressure and airflow within the drum-like enclosure before exiting at the upper periphery in a laminar flow directed toward the center of the circular disc-like top surface where the opposing flows from around the entire periphery combine to generate a vortex.

To establish a kinetic sculpture or to create a special visual effect, lightweight materials are introduced externally within the generated air flow. These lightweight materials ascend and fly and whirl about in a variety of specific patterns in the vortex depending upon the specific angles of the deployed fans; the size of the base; the volume and velocity output of each fan and the specific aerodynamic properties of the deployed materials.

A dark reflective black mirror or other flat, smooth surface may be included at the top surface of the vortex generator so that the images of the launched flying materials, including for example mylar or shimmery fabrics, are reflected by the mirror. With no visible means of propulsion, viewers of kinetic sculptures utilizing the new vortex generator as a base will observe a "dance" of the lightweight fabrics above the base, their reflections in the mirror top, and the ambient of light and shadows that are created as they fly.

For a better understanding of the present invention and a greater appreciation of its attendant advantages, reference should be made to the following detailed description taken in conjunction with the accompanying drawings and illustrations.

DETAILED DESCRIPTION OF THE INVENTION

Figure 1:
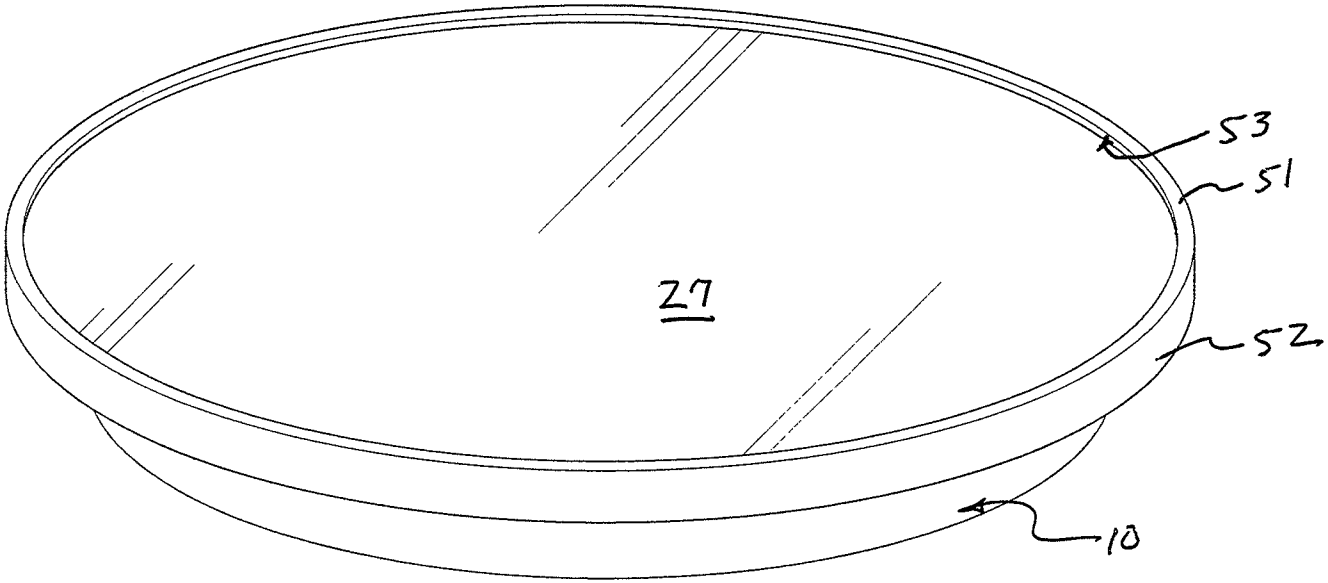
FIG. 1 is a perspective view of the new vortex generator embodying the principles of the present invention.
Figure 2:
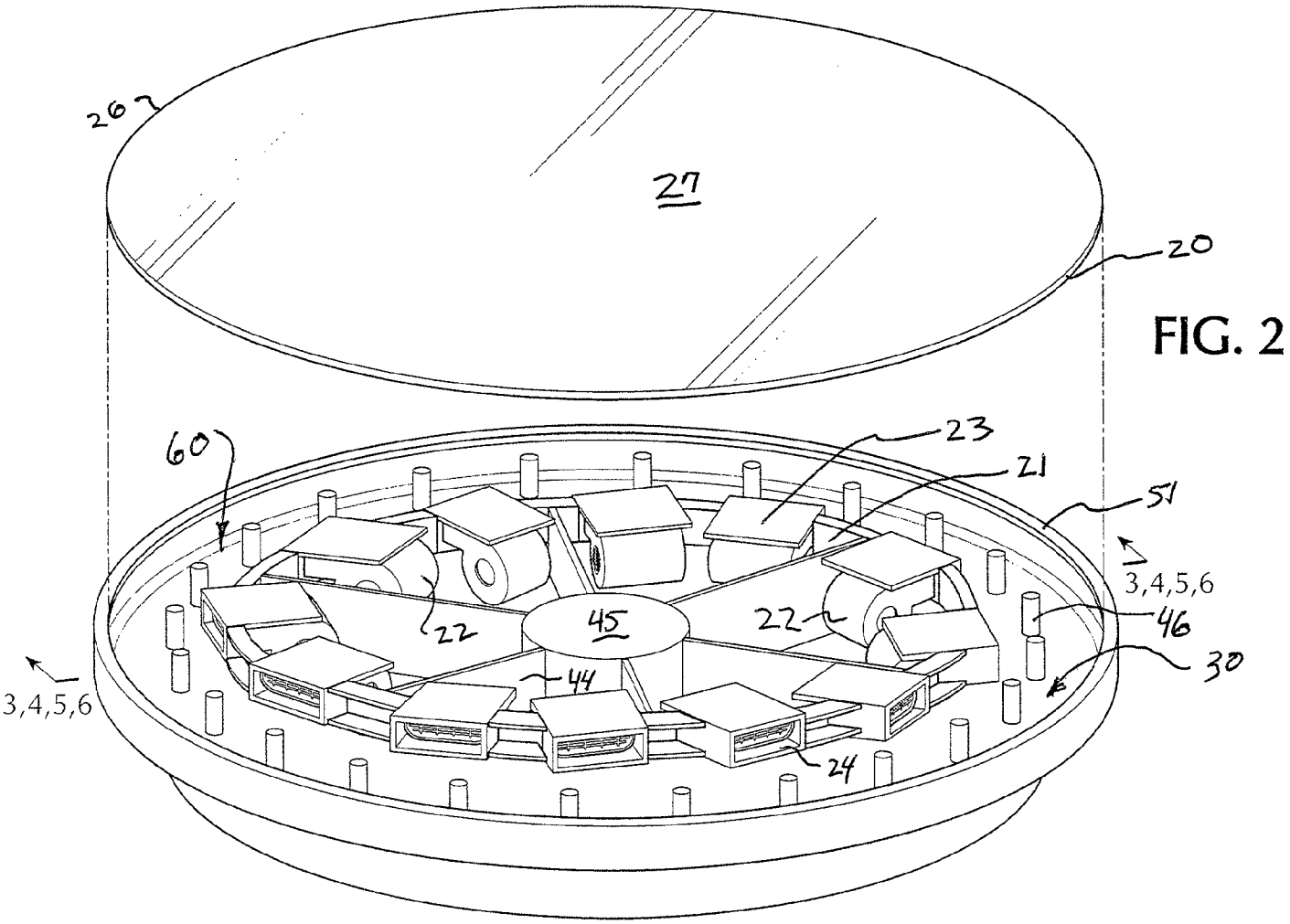
FIG. 2 is an exploded perspective view of the new vortex generator.
Figure 4:
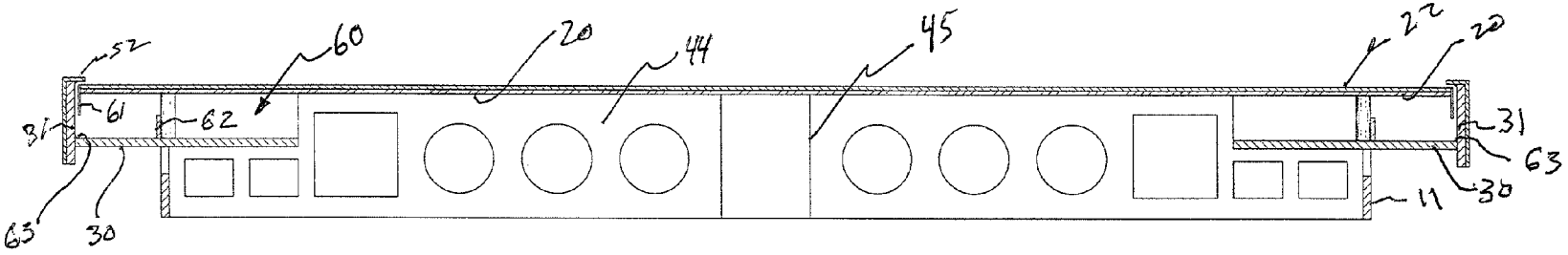
FIG. 4 is a cross-sectional view taken on plane 4-4 of FIG. 2 showing internal support structure.
Figure 5:
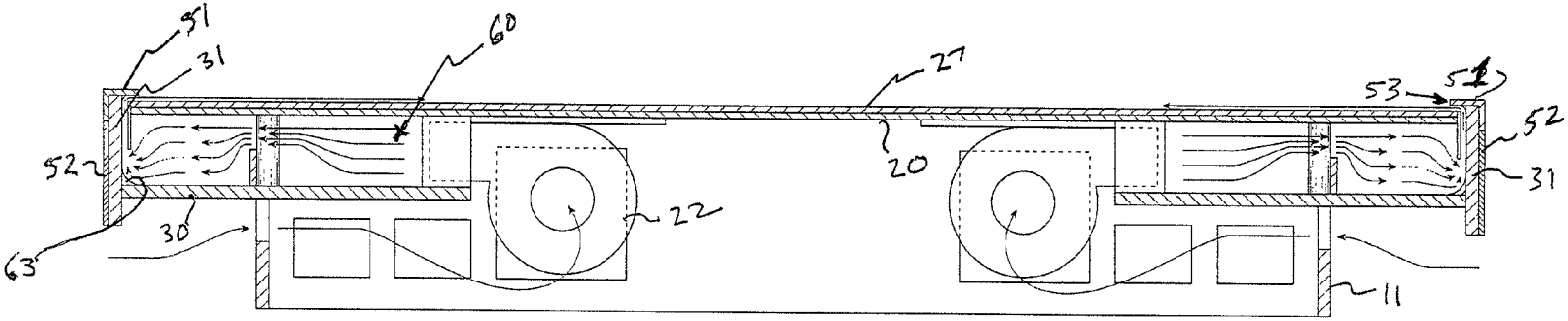
FIGS. 5 and 6 are enlarged cross-sectional views taken on planes 5-5 and 6-6, respectively, of FIG. 2 of the vortex generator.
Figure 6:
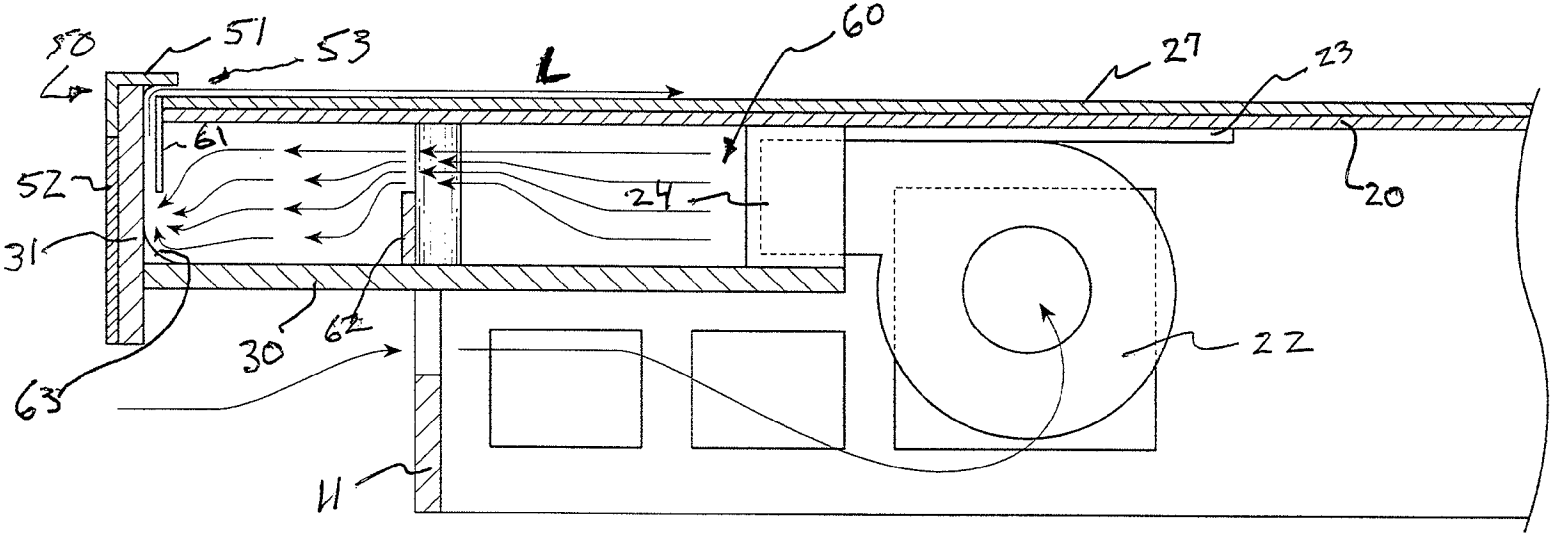
Figure 7:
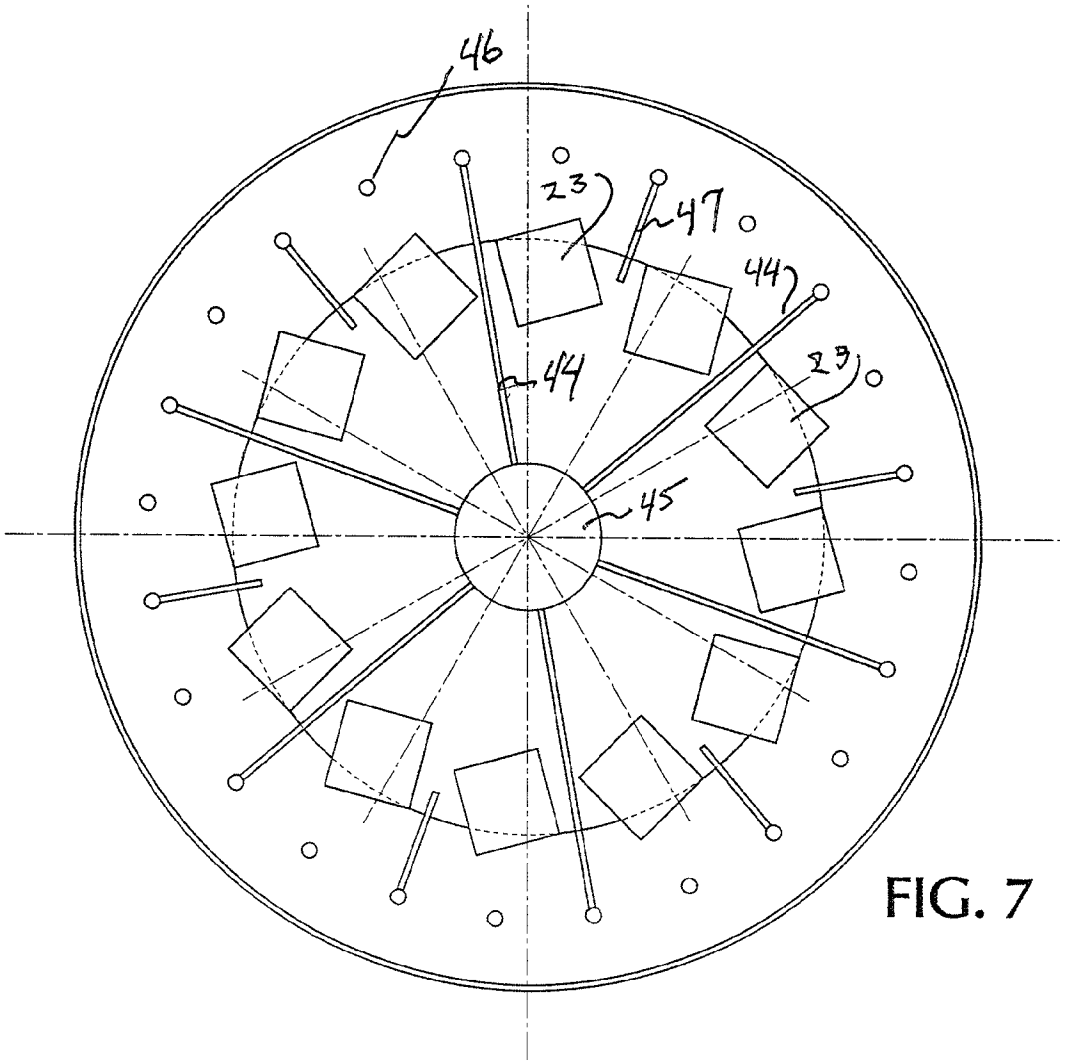
FIG. 7 is a top plan view of the arranged blowers and support elements of the vortex generator.
Figure 8:
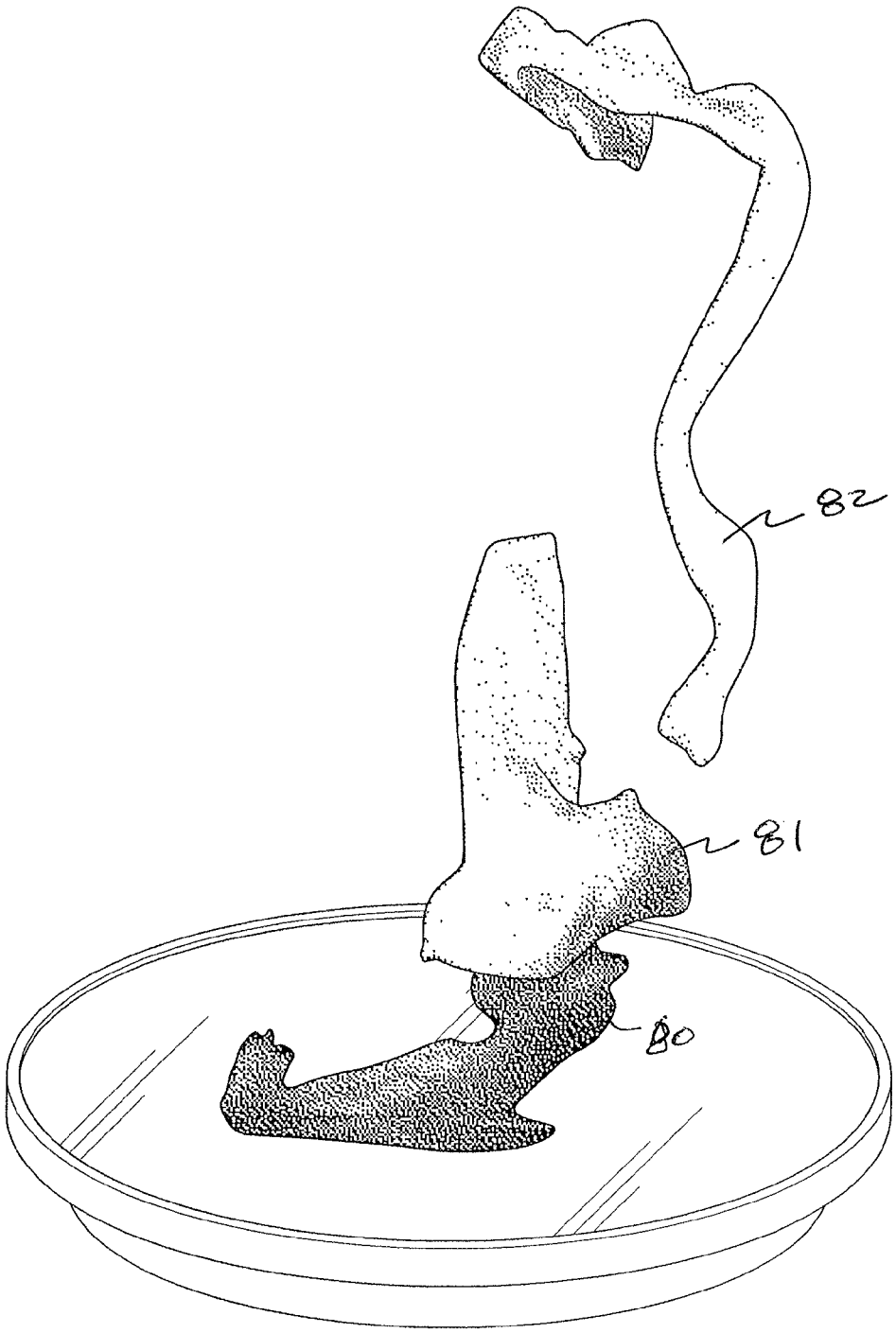
FIGS. 8-11 are perspective views of "dancing" fabrics forming kinetic sculptures in accordance with the principles of the invention.
Figure 9:
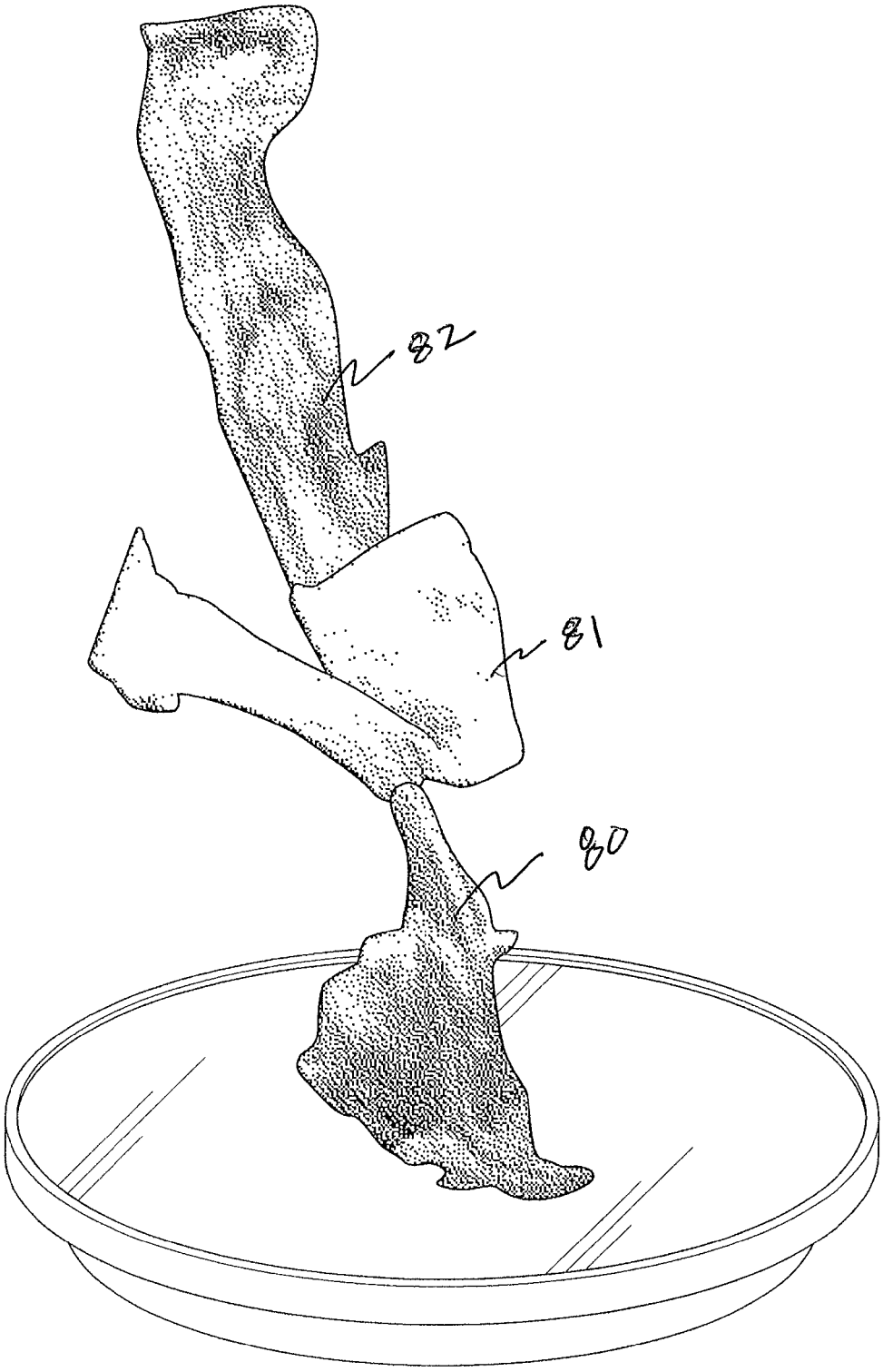
Figure 10:
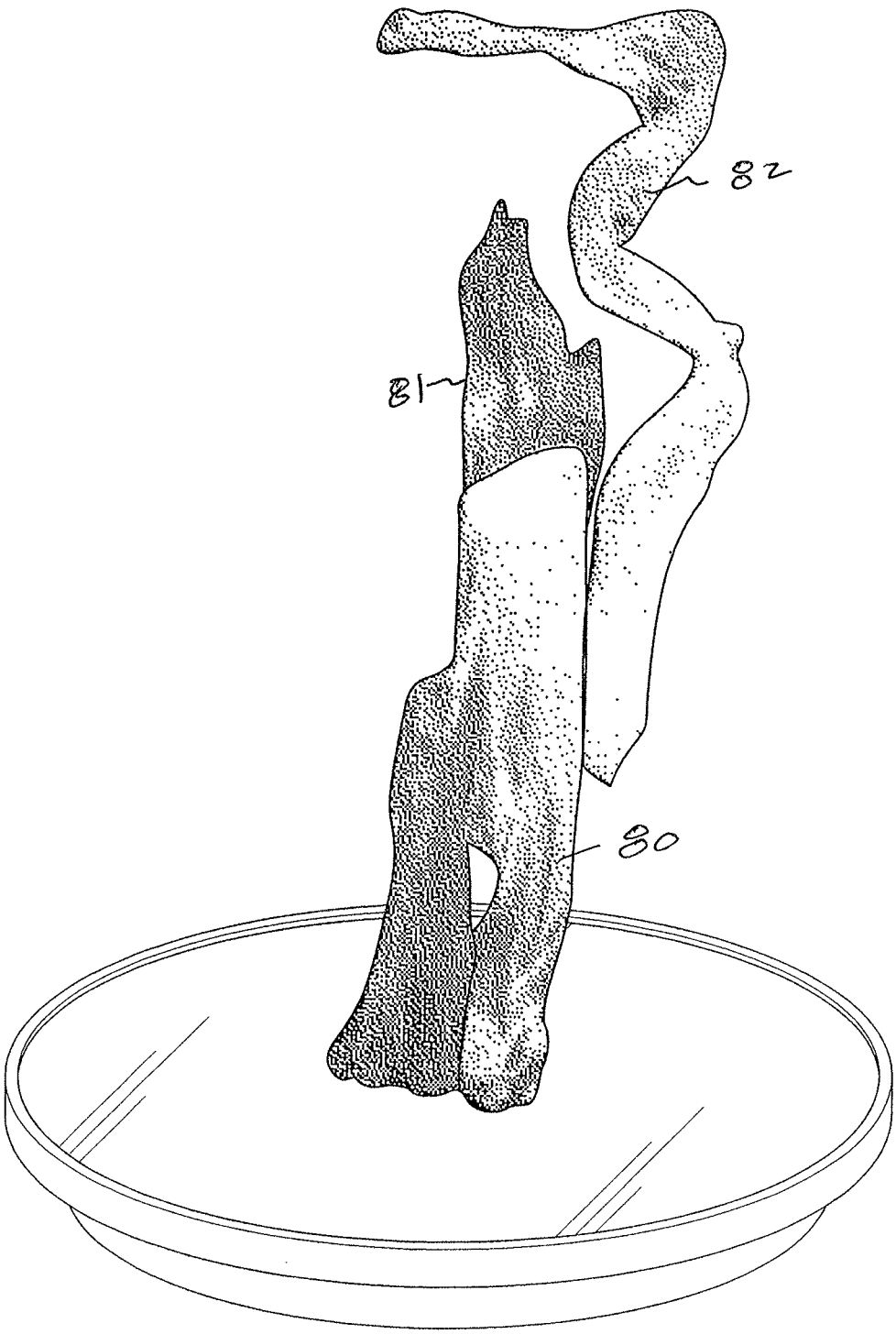
Figure 11:
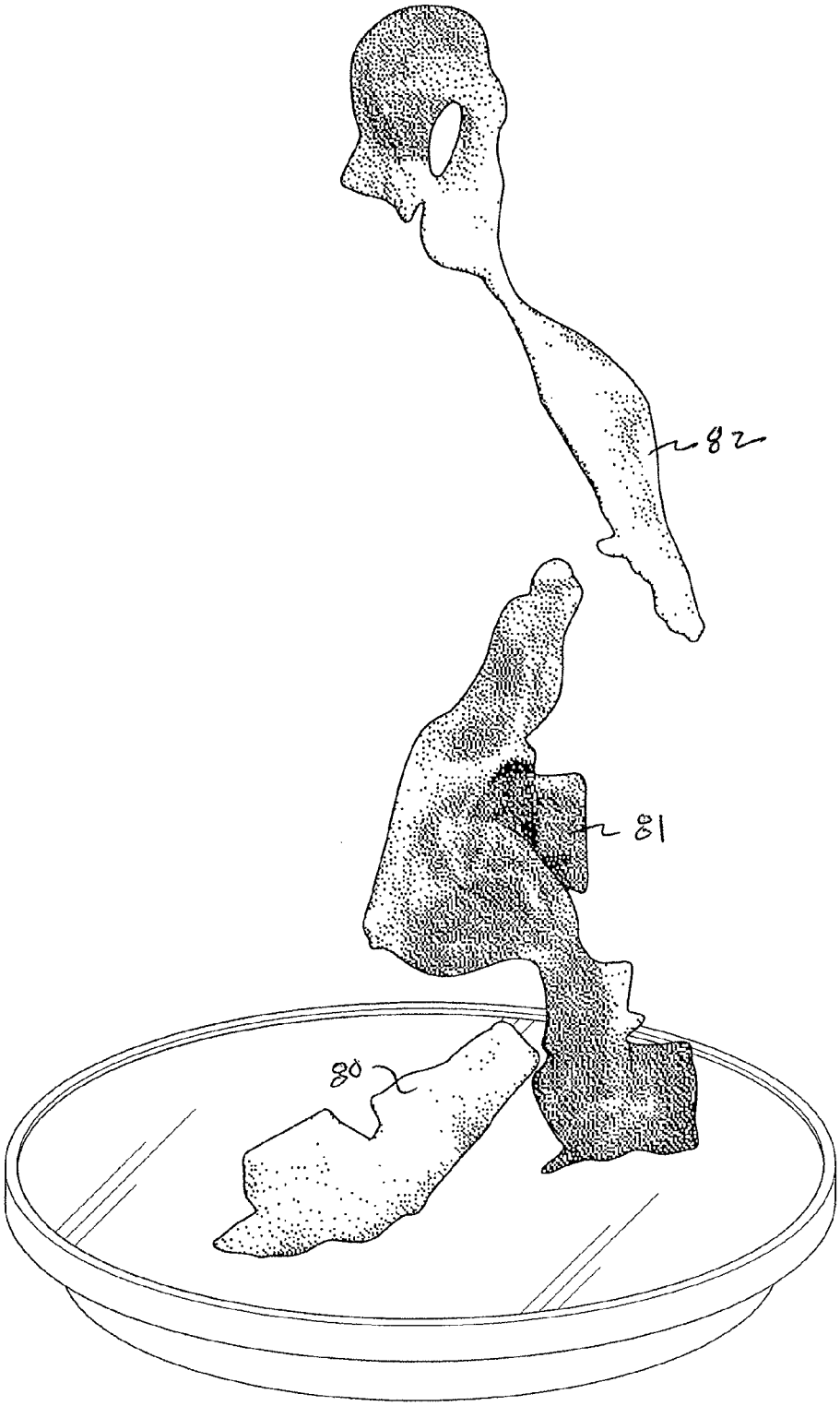

Referring initially to FIGS. 1-7, a preferred embodiment of the vortex generator of the invention generally includes a lower base support structure 10 having outer cylindrical wall 11, central column 45, and radial arms 44, which support an extended round stage 20 above a plenum chamber 60 formed in part by a planar upper disc 20 and a spaced lower disc 30. The discs 20, 30 are joined by an inner cylindrical wall 21, which is completed by and mounts twelve centrifugal blowers 22 on blower panels 23, and an outer cylindrical wall 31, to form the drum-like plenum chamber 60. A circumscribing ring 50 of L-shaped cross section having an inwardly projecting, flat circumferential lip 51 is mounted at the top of the wall 31. Cylindrical filler 52 is superimposed on wall 31 flush with ring 50 to provide a smooth aesthetic exterior as shown in FIG. 6. A dark, flat, reflective mirror 27 is superimposed on the disc 20 to enhance the special visual effects created when flyable materials are inserted into the vortex generated by the unit. An exploded perspective view of the assembled vortex generator is shown in FIG. 2.

The upper disc or stage 20 advantageously may have a flat shiny surface or as shown mounts the separate reflective mirror 27, and is supported by extended radial arms 44, abbreviated arms 47, central column 45, and vertical posts 46 extending between the discs 20 and 30. The arms 44 engage and support the underside of discs 20 and 30 as shown in FIG. 4 and may include circular and rectangular cutouts to reduce their weight and permit circulation of air in the base 10.

Figure 3:
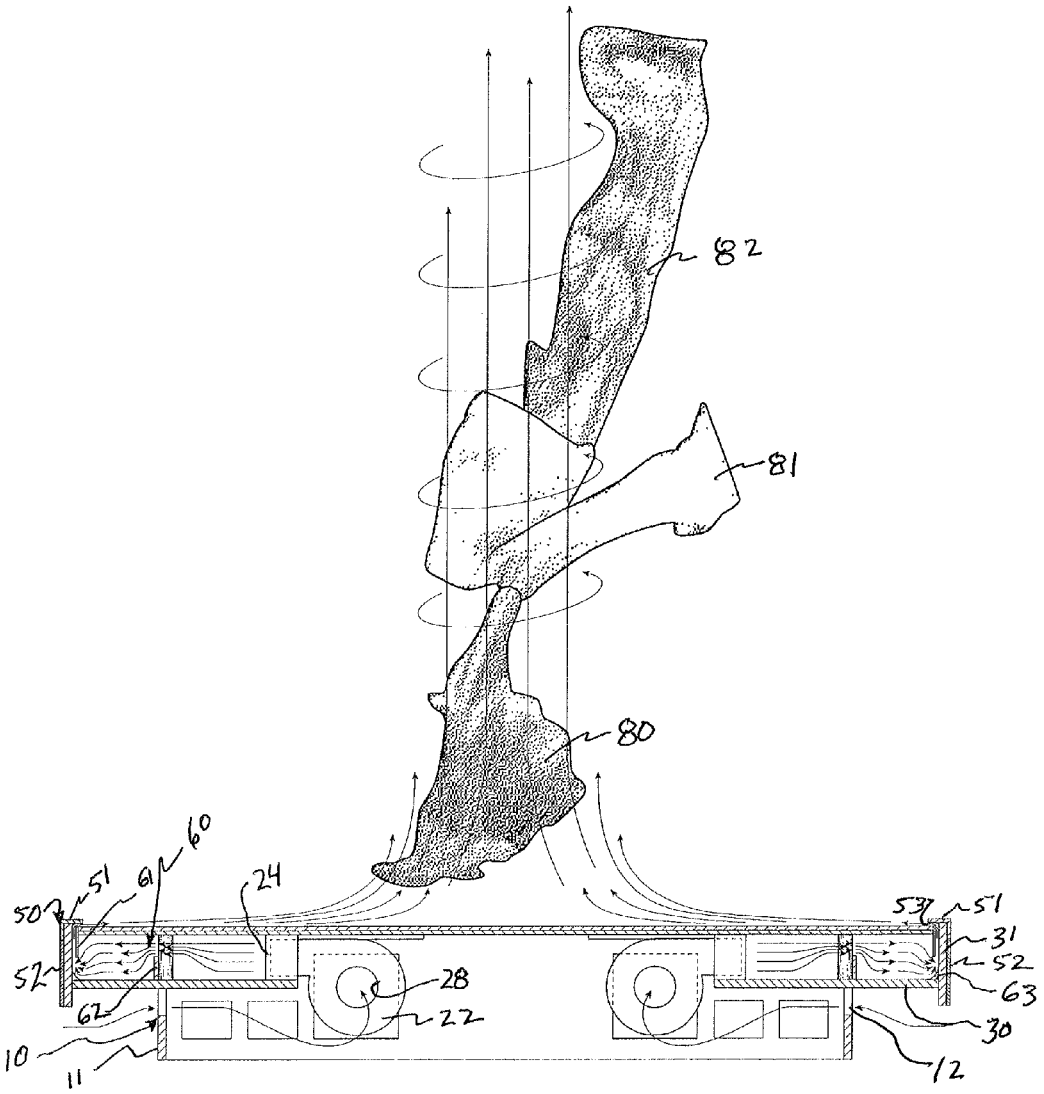
FIG. 3 is a cross-sectional view taken on plane 3-3 of FIG. 2 of the new vortex generator schematically showing the air flow and swirling fabrics in the generated vortex.

In accordance with the principles of the invention, and as shown in FIGS. 2, 3 and 6, the upper disc 20 is of slightly smaller diameter than that the diameter of the outer wall 31 to form along therewith and with the lip 51 a narrow circular peripheral opening which functions as a flow constrictor 53 at the upper disc surface or stage of the drum-like plenum 60.

As shown in FIGS. 3, 5 and 6, ambient air enters the support 10 through ports 12 formed in outer wall 11 and thereafter flows into the blower inlets 28. The air passes through the blower 22 and is pressurized and expelled through outlets 24 to pressurize the plenum 60. The pressurized air then passes over an upwardly extending baffle 62, and then between a downwardly extending baffle 61 and a convex circumscribing deflector 63 formed by molded silicone at the intersection of the disc 30 and wall 31, before exiting the plenum 60 at the peripheral flow constrictor 53. The confluence of the inwardly directed streams of the blowers 22 at the upper surface of the mirror 27 on disc 20 creates the vortex.

As shown in FIGS. 3 and 6, the downwardly projecting, circumscribing baffle 61 is supported at the periphery of the upper disc 20, while the upwardly projecting baffle 62 is supported on the lower disc 30. The baffles are of a height approximately half of the spacing of the upper and lower discs (the depth of the plenum chamber 60). The baffles 61, 62 serve to control the airflow and the pressure within the plenum chamber 60.

The blower panels 23 each mount a centrifugal blower 22, advantageously a conventional air mover with a capacity of approximately 2000-4000 CFM. As shown in FIGS. 2, 3 and 6, the blowers 22 are supported by the blower panels ("boxes") 23 and have rectangular outlet openings 24 which direct the air flow from each blower 22 into the plenum 60 at a predetermined angle with respect to the radius of the plenum to generate a laminar flow L (FIG. 6) as the air exits the plenum 60 through the flow constrictor 53. The blower panels 23 are directly fastened (by bolts not shown) to and supported by the upper disc 20.

As shown and described above and illustrated in FIGS. 3 and 6, the blowers 22 issue individual pressurized streams of air which enter the plenum 60 at the inner cylindrical wall 21. The blower air travels radially outwardly over the lower baffle 62 and the upper baffle 61 to exit the plenum 60 at the narrow circumferential opening of the flow constrictor 53 formed by the flat peripheral lip 51 and the upper edges of the cylindrical wall 31 and peripheral edges 26 of the upper disc 20.

When the pressurized air reaches the mirrored upper disc surface 27, it is in the form of a continuous laminar flow L directed radially inwardly to the center of the upper disc surface. In accordance with the invention, the radially inwardly directed flow from the peripheral edges converges at the central portion of the upper disc and interacts to create a vortex the characteristics of which can be adjusted or otherwise fine-tuned by changing the air pressure within the plenum.

To establish a kinetic sculpture or air fountain such as shown in FIGS. 8-11, lightweight elements 80, 81, 82 or other lightweight flyable material of predetermined size, shape, color, number and/or aerodynamic property such as, for example, confetti, feathers, Styrofoam, "peanuts," balloons, vapor fog, or artificial snow flakes are introduced into the vortex where the materials will fly about in generally repeating patterns. The aesthetic effects of the kinetic sculpture may be enhanced by directional external lighting (not shown) and by the flat mirror 27 on the upper disc 20.

FIGS. 2-7 herein are illustrative and exemplary of the general proportions, arrangement, and sizing of an operative vortex generator embodying the principles of the present invention. It is to be appreciated however that variations may be made in creating vortex generators within the scope of the invention. The illustrated unit may be scaled to larger and smaller sizes. The plenum chamber 60 may be appropriately pressurized by an external air source, the output of which may be introduced into the plenum by ductwork or piping. The pressure and flow generated by the illustrated series of twelve centrifugal blowers may be created by an appropriate single blower source mounted internally. Other systems of fewer or more blowers may also be employed to pressurize the plenum as will be understood by those skilled in the art. For example, in an alternative version of the new generator, fans may be located remotely from the disc-shaped enclosure and the forced air may be directed to the enclosure through a system of ducting. The flow restrictor may be formed at the periphery of the inner wall in such an arrangement. Additional louvers may be employed to generate airflow for rotational spin. The mirror may be omitted when the stage surface is shiny or otherwise reflective.

It should be understood, of course, that the specific form of the invention herein illustrated and described is intended to be representative only, as certain changes may be made therein without departing from the clear teachings of the disclosure.

I claim:

1. A vortex generator comprising:

(a) a drum-like, generally cylindrical plenum including an upper disc surface and lower disc supported by an inner cylindrical wall; an outer cylindrical wall spaced outwardly of the inner wall concentrically therewith;

(b) the upper disc having a circumferential edge spaced inwardly of the outer wall and cooperating therewith to define a circular orifice;

(c) frame means supporting the plenum;

(d) pressurizing blower means associated with the plenum, said blower means discharging air under pressure into said plenum; and (e) a circumscribing lip means mounted on the outer wall adjacent the circular orifice to establish a flow restrictor in combination therewith;

(f) whereby the flow restrictor is adapted to produce a vertical updraft of exiting pressurized air above the center of the upper disc surface.

2. The vortex generator of claim 1, in which:

(a) the blower means comprises a plurality of centrifugal blowers;

(b) said blowers are arranged at predetermined angles with respect to the radius of the cylindrical plenum.

3. The vortex generator of claim 2, in which:

(a) housing means support the centrifugal blowers adjacent the cylindrical wall.

4. The vortex generator of claim 1, in which:

(a) baffle means and deflector means are mounted in the plenum between the blower means and the flow restrictor.

5. A vortex generator, comprising:

(a) a horizontal circular stage with a planar surface of predetermined circumference;

(b) a cylindrical plenum chamber beneath said stage;

(c) a circular orifice at the circumferential edge of the stage established by and communicating between the plenum chamber and the planar surface;

(d) blower means pressurizing the plenum chamber with air under pressure and adapted to force air pressure outwardly of said orifice in a rotational pattern; and (e) lip means adjacent the orifice adapted to direct air under pressure inwardly from the orifice to the center of said stage;

(f) whereby the pressurized air creates a vertical updraft at the center of the stage.

6. The vortex generator of claim 5, in which:

(a) baffle means are included in the plenum chamber to control the air flow.

7. The vortex generator of claim 5, in which (a) the blower means include centrifugal fans.

8. The vortex generator of claim 7, in which (a) the fans are mounted externally of the plenum chamber and are oriented at angle with respect to the radius of said stage.

9. Method of generating a visual display with a generated vertical updraft and aerodynamic material, comprising:

(a) establishing a horizontal circular stage with a planar surface of predetermined circumference;

(b) providing a controlled source of invisible pressurized air;

(c) providing a circular orifice at the stage communicating between the controlled source and the planar surface;

(d) directing the invisible air under pressure outwardly of said orifice directed radially inwardly and upwardly in an ascending rotational pattern;

(e) whereby the pressurized air creates a continuous vertical updraft at the center of the stage; and (f) injecting lightweight aerodynamic material comprising a plurality of discrete, lightweight, aerodynamic elements into the updraft to establish a dynamic visual display.

10. A kinetic sculpture comprising:

(a) a horizontal circular stage with a planar surface of predetermined circumference;

(b) a cylindrical plenum chamber beneath said stage;

(c) a circular orifice at the circumferential edge of the stage established by and communicating between the plenum chamber and the planar surface;

(d) blower means pressurizing the plenum chamber with air under pressure and adapted to force air pressure outwardly of said orifice in a rotational pattern;

(e) lip means adjacent the orifice adapted to direct air under pressure inwardly from the orifice to the center of said stage;

(f) whereby the pressurized air creates a vertical updraft at the center of the stage; and (g) lightweight aerodynamic material suspended in the generated vertical updraft.

11. The kinetic sculpture of claim 10, in which:

(a) the lightweight material is a flexible sheet.

12. The kinetic sculpture of claim 10, in which:

(a) the lightweight material is confetti, feathers, Styrofoam, "peanuts," balloons, vapor fog, or artificial snow flakes.

13. An air fountain comprising:

(a) a horizontal circular stage with a planar surface of predetermined circumference;

(b) blower means providing a source of pressurized air;

(c) circular orifice means at the circumferential edge of the stage established by and communicating between the blower and the planar surface;

(d) lip means adjacent the orifice adapted to direct air under pressure inwardly from the orifice to the stage surface;

(e) whereby the pressurized air creates a vertical updraft at the center of the stage; and (f) lightweight aerodynamic material suspended in the generated vertical updraft.

14. The air fountain of claim 13, which includes:

(a) a cylindrical plenum chamber beneath the stage;

(b) said blower means pressurizing the plenum chamber.

* * * * *